US009854363B2

(12) United States Patent
Sladeczek et al.

(10) Patent No.: US 9,854,363 B2
(45) Date of Patent: Dec. 26, 2017

(54) LOUDSPEAKER SYSTEM

(71) Applicant: Fraunhofer-Gesellschaft zur Foerderung der angewandten Forschung e.V., Munich (DE)

(72) Inventors: Christoph Sladeczek, Ilmenau (DE); Daniel Beer, Martinroda (DE); Andreas Franck, Southampton (GB)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/366,573

(22) Filed: Dec. 1, 2016

(65) Prior Publication Data

US 2017/0085990 A1 Mar. 23, 2017

Related U.S. Application Data

(63) Continuation of application No. PCT/EP2015/062588, filed on Jun. 5, 2015.

(30) Foreign Application Priority Data

Jun. 5, 2014 (DE) ..... 10 2014 210 821
Aug. 29, 2014 (DE) ..... 10 2014 217 344

(51) Int. Cl.
*H04R 3/14* (2006.01)
*H04S 3/00* (2006.01)
*H04S 7/00* (2006.01)

(52) U.S. Cl.
CPC ..... *H04R 3/14* (2013.01); *H04S 3/00* (2013.01); *H04S 7/302* (2013.01); *H04S 7/303* (2013.01);
(Continued)

(58) Field of Classification Search
CPC . H04S 3/00; H04S 7/303; H04S 7/307; H04S 7/302; H04R 3/14; H04R 2203/12; H04R 2499/13; H04R 2205/024
(Continued)

(56) References Cited

U.S. PATENT DOCUMENTS 5,754,664 A * 5/1998 Clark ..... B60R 11/0217 296/214
5,821,471 A 10/1998 McCuller
(Continued)

FOREIGN PATENT DOCUMENTS

EP 1427253 A2 6/2004
EP 2143300 B1 9/2011
(Continued)

*Primary Examiner* — Melur Ramakrishnaiah
(74) *Attorney, Agent, or Firm* — Perkins Coie LLP; Michael A. Glenn

(57) ABSTRACT

A loudspeaker system for a vehicle includes a loudspeaker array including a plurality of electroacoustic sound transducers that can be controlled individually, such that a user-specific audio signal can be reproduced for different users at different listening positions in a vehicle interior of the vehicle via the plurality of electroacoustic sound transducers. Here, the loudspeaker array or a sound outlet of the loudspeaker array is arranged in particular between at least two of the listening positions in the vehicle interior, i.e. for example between the driver and the passenger seat.

17 Claims, 7 Drawing Sheets

(52) U.S. Cl.
CPC ..... *H04S 7/307* (2013.01); *H04R 2203/12* (2013.01); *H04R 2205/024* (2013.01); *H04R 2499/13* (2013.01)

(58) Field of Classification Search
USPC ..... 381/86, 300, 302, 94.1, 71.1
See application file for complete search history.

(56) References Cited

U.S. PATENT DOCUMENTS

| | | | | |
|---|---|---|---|---|
| 6,237,715 | B1 | 5/2001 | Tracy et al. | |
| 7,343,020 | B2 | 3/2008 | Thigpen et al. | |
| 8,073,156 | B2 | 12/2011 | Hutt et al. | |
| 8,126,159 | B2 | 2/2012 | Goose et al. | |
| 2003/0021433 | A1 | 1/2003 | Lee et al. | |
| 2006/0269095 | A1 | 11/2006 | Matsumura et al. | |
| 2008/0130922 | A1 | 6/2008 | Shibata et al. | |
| 2008/0212805 | A1 | 9/2008 | Fincham et al. | |
| 2008/0273723 | A1 | 11/2008 | Hartung et al. | |
| 2009/0067657 | A1 | 3/2009 | Yasushi et al. | |
| 2012/0121113 | A1 | 5/2012 | Li et al. | |
| 2013/0259254 | A1* | 10/2013 | Xiang ..... | G10K 11/175 381/73.1 |

FOREIGN PATENT DOCUMENTS

| | | | |
|---|---|---|---|
| JP | H05199595 | A | 8/1993 |
| JP | H06289880 | A | 10/1994 |
| JP | 2001286000 | A | 10/2001 |
| KR | 1020100069401 | A | 6/2010 |
| WO | 2004075601 | A1 | 9/2004 |
| WO | 2012068174 | A2 | 5/2012 |

* cited by examiner

LOUDSPEAKER SYSTEM

CROSS-REFERENCE TO RELATED APPLICATIONS

This application is a continuation of copending International Application No. PCT/EP2015/062588, filed Jun. 5, 2015, which is incorporated herein by reference in its entirety, and additionally claims priority from German Applications Nos. 102014210821.7, Jun. 5, 2014, and 102014217344.2, filed Aug. 29, 2014, which are all incorporated herein by reference in their entirety.

Embodiments of the present invention relate to a loudspeaker system for a vehicle, in particular with a loudspeaker array, generally to loudspeaker arrays having a plurality of electroacoustic sound transducers in different arrangement configurations and to a loudspeaker array with sound guidance.

BACKGROUND OF THE INVENTION

Future infotainment systems in vehicles and the associated loudspeaker systems in vehicles have to fulfill challenging tasks in complex traffic scenarios. Therefore, absolutely reliable functioning is a prerequisite, wherein risks for the driver, for example by erroneous function, have to be avoided in any driving situation. Here, communication requirements and fast provision of information as well as undisturbed audio reproduction play an important role. Here, not only vehicle sounds are considered as spurious signals, but also parallel consumption of different audio content, such as when talking on the phone and consuming media content at the same time from the perspective of several passengers. Such challenges necessitate system characteristics allowing individual sound exposure of limited audio regions, so-called sound or listening zones.

Typically, apart from the electroacoustic components, efficient algorithms for noise suppression and effective data communication for regulating the adapted system are necessitated for realizing these systems.

Starting from this problem, several concepts exist that are used in the market and are at least partly proven, respectively. One example is the personalized sound exposure (by means of sound zones) by using loudspeakers in direct proximity to the ears of the listener in the respective sound zone, e.g. by loudspeaker integration in the respective headrests of the respective car seat per listening zone. Such a system with loudspeakers divided into groups is disclosed in the U.S. Pat. No. 8,126,159. One advantage of this approach is the high acoustic separation with respect to the adjacent sound zones due to the great difference in the listening distance. This is based on the theoretical model of level decrease of approximately 6 dB per duplication of the distance (with ideal spherical wave propagation). A disadvantage of this approach is the high sensitivity to disturbances, e.g. due to head movements. This results, on the one hand, in high level fluctuations and significant impediments of spatial perception, e.g. loss of the stereo images.

A second conventional approach concerns personalized sound zones that can be generated by using ultrasound technology. Listening sound is modulated to ultrasound carriers and radiated to the listening zone in a highly focused manner. A prerequisite of this modulation principle is the radiation of very high ultrasound levels, e.g. higher than 130 dB. The advantage of this approach is that the ultrasound, due to the favorable ratios of wavelength to size of the active "radiation area" defined by the size of the loudspeaker and the loudspeaker array, respectively, is radiated in a more focused manner than frequencies of the audio frequency range. Thus, increased acoustical separation of the sound zones is possible, while maintaining the size of the used loudspeaker technology. The disadvantage of this approach is not only that ultrasound can be unhealthy from certain power levels (see in this regard usage of ultrasound in the medical field for destroying kidney stones), but also that, when using ultrasound, strong reflections in the vehicle interior result, which have a disadvantageous effect on the acoustic channel separation. Further, ultrasound usage causes high power consumption, which is equivalent to low energy efficiency. Additionally, highly non-linear transmission behavior occurs due to the demodulation principle, resulting in low sound quality which is normally only sufficient for speech reproduction.

A further conventional approach is based on so-called beamforming. For this, several loudspeakers are used, which are, for example, distributed within the vehicle and/or are grouped into a loudspeaker array. By the specific control of each loudspeaker, directed sound radiation, e.g. for individual sound zones, is obtained. In this context, reference is made to U.S. Pat. No. 8,073,156 disclosing the usage of linear loudspeaker arrays in a vehicle. Thereby it is possible to focus a sound pattern to one or several positions in the vehicle. Patent document US 2012/0121113 discloses the usage of a further loudspeaker array in a vehicle including the respective controller. The advantage with respect to the first approach is a more stable sound zone, even with head movement. Further, no direct proximity of the seating position to a loudspeaker installation position is necessitated. Compared to the second approach, there is no risk potential due to the high sound pressure. Additionally, better sound quality can be obtained compared to this ultrasound approach. A disadvantage, however, is the obtainable sound focusing, frequently resulting in insufficient channel separation, in particular caused by the realizable array dimensions, the realizable sound transducer distances (distance from adjacent electroacoustic sound transducers) and the number of sound transducers per array. Additionally, the channel separation of previous beamforming approaches is lowered by the spatial acoustic influences in the vehicle, reflections and room modes, respectively.

Further, U.S. Pat. No. 7,343,020 discloses an automobile audio system with directional planar sound transducers for generating stereo or surround sounds individually for each passenger. US Patent 2003/0021433 discloses a loudspeaker configuration together with a signal processor for stereo channel generation for each passenger individually by using a central loudspeaker. EP Patent 2 143 300 B1 discloses a vehicle loudspeaker system with directional sound transducers directed to the respective seating positions (=listening positions). All three latter approaches from the US/EP patents have in common that insufficient channel separation or crosstalk can result due to the loudspeaker technology to be derived. Thus, there is the need for an improved approach.

SUMMARY

According to an embodiment, a loudspeaker system for a vehicle may have: a loudspeaker array including a plurality of electroacoustic sound transducers that can be controlled individually, such that a user-specific audio signal can be reproduced for different users at different listening positions in a vehicle interior via the plurality of electroacoustic sound transducers, wherein the loudspeaker array is arranged in a roof lining of the vehicle, centrally between at least all listening positions in the vehicle interior, such that a distance between the loudspeaker array and all of the listening positions is the same, with a deviation of +/−30%, wherein the loudspeaker system includes, per listening position, at least one additional loudspeaker system including at least one additional loudspeaker or an additional loudspeaker array, wherein the additional loudspeaker system includes a structure-borne sound loudspeaker that is arranged in a foot space allocated to the listening position, in a seat allocated to the listening position and/or a headrest allocated to the listening position and/or that is mechanically coupled to the seat allocated to the listening position; wherein the loudspeaker system is configured to perform, with the help of the plurality of the electroacoustic sound transducers of the loudspeaker array, acoustic beamforming for forming the beams; wherein middle and higher frequencies are reproduced in a directed manner for the different listening positions by means of the array, while the low frequencies are only represented locally via the structure-bound sound transducer.

According to another embodiment, a loudspeaker system for a vehicle may have: a loudspeaker array including a plurality of electroacoustic sound transducers that can be controlled individually, such that a user-specific audio signal can be reproduced for different users at different listening positions in a vehicle interior via the plurality of electroacoustic sound transducers, wherein the loudspeaker array or a sound outlet of the loudspeaker array is arranged between at least two of the listening positions in the vehicle interior, wherein the loudspeaker system includes, per listening position, at least one additional loudspeaker system including at least one additional loudspeaker or an additional loudspeaker array, wherein the additional loudspeaker system includes a structure-borne sound loudspeaker that is arranged in a foot space allocated to the listening position, in a seat allocated to the listening position and/or a headrest allocated to the listening position and/or that is mechanically coupled to the seat allocated to the listening position, wherein the loudspeaker system includes a loudspeaker array, having: a plurality of electroacoustic sound transducers coupled to first sound guides for sound output in a first area, wherein each sound guide includes a sound outlet opening, wherein the plurality of sound outlet openings are arranged such that an average distance between the sound outlet openings is smaller than a possible average distance between the juxtaposed electroacoustic sound transducers.

An embodiment according to a first aspect includes a loudspeaker system for a vehicle with a loudspeaker array. The loudspeaker array includes a plurality of electroacoustic sound transducers which can be individually controlled, such that a user-specific audio signal can be reproduced for different users at different listening positions in a vehicle interior via the plurality of electroacoustic sound transducers. The loudspeaker array or, if sound guides are used, a sound outlet of the loudspeaker array is arranged in particular between at least two listening positions in the vehicle interior, i.e. for example between the driver and the passenger seat.

Thus, the embodiments of the first aspect are based on the finding that a loudspeaker system for a vehicle can be improved in particular with regard to channel separation, e.g. when reproducing different audio content at the different listening positions in that a loudspeaker array is arranged centrally, in the sense of centered with regard to all or the relevant listening positions. For each listening position (or each relevant listening position), the used loudspeaker system can build a separate beam, or for stereo, several separate beams per zone. Due to the centered arrangement of the loudspeaker array, e.g. in the roof lining between the seats, it is obtained that the loudspeaker array has approximately the same distance to each relevant listening position, such that each beam has a similar extension and in particular that the beams are oppositely oriented with regard to their direction, which is optimum with regard to channel separation, in particular with user-specific audio reproduction.

As already indicated above, advantageous positioning of the loudspeaker array would be, according to embodiments, in the roof lining of the vehicle, in the center console, in the dashboard or in the rear shelf, wherein, according to further embodiments, it is of particular importance that a distance between the array and the listening positions and at least the relevant listening positions (subset of all listening positions), respectively, is essentially the same, i.e. with a deviation of +/−30%.

Depending on the listening position, according to further embodiments, at least one additional loudspeaker, such as the normally existing loudspeaker in the door and the mirror triangle and/or a differently positioned additional loudspeaker, respectively, can be provided. The additional loudspeaker can also be implemented as structure-borne sound transducer. The additional loudspeaker is advantageously arranged closer to the user than the loudspeaker array. Due to such a dense arrangement it is possible that the sound radiated from the additional loudspeaker can almost be neglected with regard to the other listening positions, since significantly lower sound levels and greater level differences due to the great difference in the listening position can be used. By this additional loudspeaker it is possible to generate, for each listening position, stereo but also mono with local level increase or frequency extension (e.g. bass).

Stereo can also be generated with the help of the plurality of the electroacoustic sound transducers and the loudspeaker array based on the technology of acoustic beamforming. Here, for example, at least two beams or also one stereo beam are generated per listening position. In this context, it should be noted that it would be possible, with the help of transfer functions, emulating psychoacoustic effects, the sound sources to be generated are positioned virtually in space. According to additional embodiments, it would be advantageous when positioning the sources by means of beamforming that the beams are tracked by considering the seating position or head position of the listener, such that independent of the seating position a consistently good reproduction effect results.

According to a further embodiment, the loudspeaker system comprises a signal processor that individually controls the electroacoustic sound transducer and/or the additional loudspeakers, for example for beamforming.

A further embodiment according to a second aspect provides a loudspeaker array with a plurality of first electroacoustic sound transducers, e.g., small sound transducers arranged in a first line and a plurality of second electroacoustic sound transducers, e.g., great sound transducers arranged on the very first line. Here, the average distance between the first electroacoustic sound transducers is smaller compared to the average distance between the second electroacoustic sound transducers.

According to a further embodiment of the second aspect, the first electroacoustic sound transducers are arranged in a first face area while the second electroacoustic sound transducers are arranged in a second face area. Here, the average density of the arrangement of the first electroacoustic sound transducers (e.g., again the small electroacoustic sound transducers for the treble range) is greater than the average density of the second electroacoustic sound transducers (e.g., great electroacoustic sound transducer for the bass range).

Embodiments of this second aspect are based on the finding that the arrangement of sound transducers of different types in an array does not necessarily have to be distributed equally, but that it can even be advantageous when smaller sound transducers that are typically used for high-frequency ranges are installed with a higher "packing density" than greater sound transducers for lower frequency ranges, since the option of highly focused radiation in the higher frequency range but also the localization for a higher frequency range is better than in the low frequency range. Thus, such a sound transducer arrangement offers the advantage that both a wide frequency range and an option for accurate sound focusing can be obtained.

In respective embodiments, an above described arrangement can be performed either on one line by encompassing at least two of the first electroacoustic sound transducers by one of the second electroacoustic sound transducers each per side or in a two-dimensional range within a square. Further, it would also be possible that additionally third electroacoustic sound transducers are provided which are incorporated into the array in a similar arrangement. Here, a similar arrangement means that the average distance between adjacent sound transducers of the same type increases with increasing sound transducer sides and that the average density decreases, respectively.

The loudspeaker array according to this second aspect is suitable to serve as a loudspeaker array in the loudspeaker system according to the first aspect. This is particularly advantageous since the stated array arrangement with varying packing density offers the option of realizing arrays having a high and adjustable directional characteristic with a simultaneously small installation space, as it is necessitated, for example, with a central arrangement in the vehicle interior.

A further embodiment according to a third aspect provides a loudspeaker array with a plurality of electroacoustic sound transducers coupled at their sound radiation area, with sound guides for sound output and sound control, respectively, wherein each sound guide includes a sound outlet opening. The plurality of sound outlet openings is arranged such that an average distance between the sound outlet openings is smaller than a (possible) average distance between the juxtaposed electroacoustic sound transducers.

The embodiments of this third aspect are based on the finding that a compact distribution of the individual sound sources, in particular with regard to selective sound focusing during sound radiation, is advantageous in loudspeaker arrays. In order to obtain compact distribution even for arrays with great expansion, e.g., due to large sound transducers, according to the invention (for this third aspect), funnel-shaped sound guides are used that are each coupled to an electroacoustic sound transducer. Here, the sound outlet openings of the sound guides are smaller than the sound inlet openings of the sound guides, such that the sound outlet openings can be arranged as a compact field. Thus, the directional characteristics for an array coupled to a plurality of sound guides can be improved.

According to embodiments, the loudspeaker array according to this third aspect can easily be combined with the basic idea of the loudspeaker array of the second aspect. Further, usage of the sound guides in loudspeaker systems of the first aspect is possible and advantageous, respectively.

BRIEF DESCRIPTION OF THE DRAWINGS

Embodiments of the present invention will be detailed subsequently referring to the appended drawings, in which.

DETAILED DESCRIPTION OF THE INVENTION

Before embodiments of the present invention will be discussed in more detail based on the figures, it should be noted that the same elements or structures are provided with the same reference numbers, such that the description is inter-exchangeable or inter-applicable.

Figure 1A:
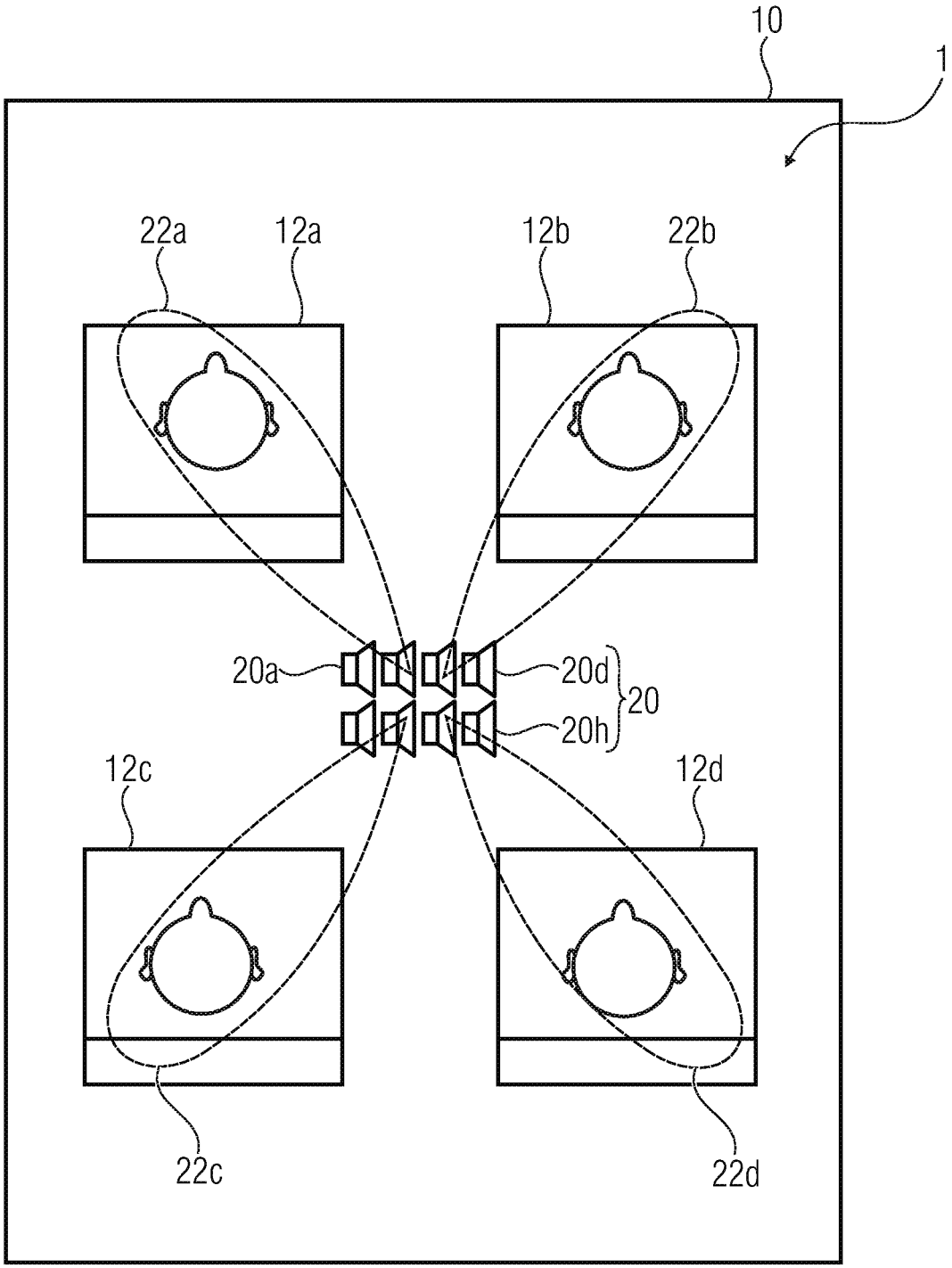
FIG. 1*a* is an exemplary diagram of an arrangement of a loudspeaker array in a vehicle according to a first embodiment (mono) of the first aspect.

FIG. 1*a* shows a schematically illustrated vehicle interior 10 in a top view with four listening positions 12*a*, 12*b*, 12*c* and 12*d*, each defined by a seat on which the potential listener can sit. The loudspeaker system 1 for the vehicle interior 10 includes a loudspeaker array 20 including the plurality of electroacoustic sound transducers 20*a*-20*h*.

As illustrated herein, the array 20 with regard to the vehicle interior 10 is arranged in a relatively central manner, which has the effect that the array 20 is arranged at least between two listening positions (subset of all listening positions 12*a*-12*d*), here even between the four listening positions 12*a*-12*d*. Possible installation spaces for the loudspeaker array are, for example the roof lining, the central console, but also alternatively the dashboard and the rear shelf, respectively. Generally, this means that the loudspeaker array 20 can be installed above or below or even at the same height as the listening zones 12*a*-12*d* and the ear height of the listener, respectively. For completeness sake, it should be noted that centrally relates to all listening zones 12*a*-12*d* or at least to a subset of the listening zones 12*a*-12*d*, e.g., the listening zone 12*a* and 12*b*. In the following, the mode of operation of the loudspeaker system for the vehicle realized in that manner will be discussed.

In the illustrated example, the loudspeaker system array forms, per listening position 12*a*-12*d*, one beam 22*a*-22*d* that is advantageously directed to the listening zones 12*a*-

12*d* or at least allocated to the same. The formation of these beams 22*a*-22*d* is performed in that the sound transducers 20*a*-20*h* of the loudspeaker array 20 are differently controlled, for example by considering so-called beamforming algorithms which can also incorporate the radiation characteristic of the individual transducers 20*a*-20*h* as well as influences of room acoustics. In the context of this signal processing, reference is made to the basics of the teachings of wave field synthesis which largely provides the basis for the beamforming performed herein. This means that the loudspeaker array 20 is configured to build a separate beam 22*a*-22*d* per listening position 12*a*-12*d*, wherein, due to the central arrangement, each beam 22*a*-22*d* is oriented oppositely with regard to its orientation (from the center towards the listening positions 12*a*-12*d*). Additionally (due to the central arrangement), the loudspeaker array 20 has approximately the same distance to each listening position 12*a*-12*d*, such that each beam 22*a*-22*d* has similar characteristics (e.g., expansion and level). These two characteristics contribute significantly to the obtained channel separation between the channels 22*a*-22*d*. An advantage of beams 22*a*-22*d* generated by beamforming is that the channel separation is so good that user-specific audio signals can be generated for the listening zones 12*a*-12*c*. Due to this, not only a different audio signal in the sense of loudness but even different audio content can be reproduced in the different listening zones 12*a*-12*d*. Additionally, it would also be possible that in one of the sound zones 12*a*-12*d* silence can specifically be generated by noise cancellation.

With reference to the embodiment of FIG. 1*a*, it should be noted that the illustrated arrangement even fulfils a second optional condition, namely that the distance between the loudspeaker array 20 and the individual listening positions 12*a*-12*d* is essentially the same, i.e., with a tolerance of +/−30% (central arrangement). Further, the central position of the array 20 reduces spurious influences of room acoustics with regard to the sound zones, e.g., due to sound reflections at the side windows.

According to embodiments, instead of the entire loudspeaker array 20, a sound outlet of a sound guide (cf. FIG. 3) coupled to the loudspeaker array can be positioned centrally or generally between at least two of the listening zones 12*a*-12*d*. The sound guide typically includes one sound conductor per sound transducer 20*a*-20*h* coupled to the respective sound transducer 20*a*-20*h*, wherein a plurality of the sound outlets of the sound conductors form the sound outlet of the sound guide. Here, the actual sound transducer array 20 can be installed at a specific position within the car (e.g., in the trunk), e.g. due to lack of space, and the sound guide can guide the sound to the respective central sound outlet point.

By loudspeaker arrays arranged in that way, it is also possible to generate stereo or even 3D surround sound per listening position 12*a*-12*d* as is illustrated with reference to FIG. 1*b*.

Figure 1B:
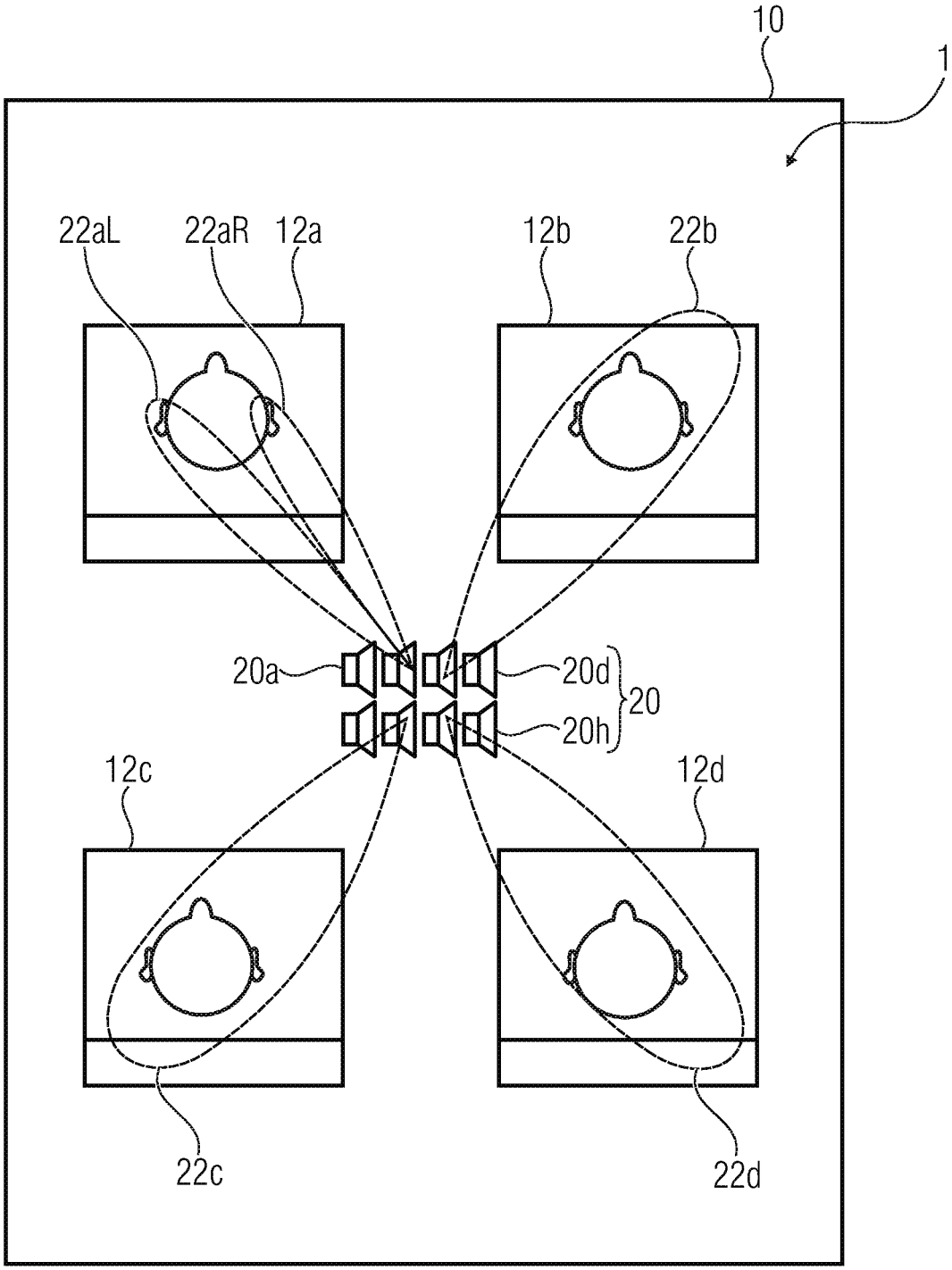
FIG. 1*b* is a schematic diagram of an arrangement in a vehicle according to a further embodiment (partly stereo) of the first aspect.

FIG. 1*b* shows the top view of the vehicle interior 10 with the four listening positions 12*a*-12*d* and the loudspeaker array 20 of the loudspeaker system 1. Generating stereo is discussed based on the position 12*a*, however can also be transferred to the other listening positions 12*a*-12*d*.

As illustrated in FIG. 1*b*, a double beam including the beams 22*a*L and 22*a*R is generated for the listening position 12*a*. The beams 22*a*L and 22*a*R are, on the one hand, directed to the left ear (22*a*L) and, on the other hand, to the right ear (22*a*R) of the listener at the listening position 12*a*. Generating sound channels per listening position 12*a*-12*d* is not limited to the number 2 for stereo. Rather, several beams can be generated per listening position 12*a*-12*d* in order to simulate surround sound. Here, according to further embodiments, it would also be possible to consider transfer functions emulating psychoacoustic effects when generating the beams 22*a*L, 22*a*R, 22*b*, 22*c* and 22*d* in signal processing in order to improve positioning of the virtual sound sources in the interior 10. Examples for such transfer functions are HRTF functions and/or Blauert's directional bands.

According to further embodiments, it would also be possible that when orienting the beams 22*a*L, 22*a*R, 22*b*, 22*c* and 22*d*, sound reflections (e.g., via glass areas) or sound absorption are considered. It is also considered in advance to what extent direct sound reproduction and/or indirect sound reproduction, i.e. by incorporating wall reflections or also optional sound guides, is used.

Again, according to further embodiments, it would be possible that the beams 22*a*L, 22*a*R, 22*b*, 22*c* and 22*d* are oriented in dependence on the seating position defining the listening position 12*a*-12*b*, 12*c* and 12*d*. Here, for example, informational coupling of the loudspeaker system to the open (electric) seat adjustment would be possible.

Figure 1C:
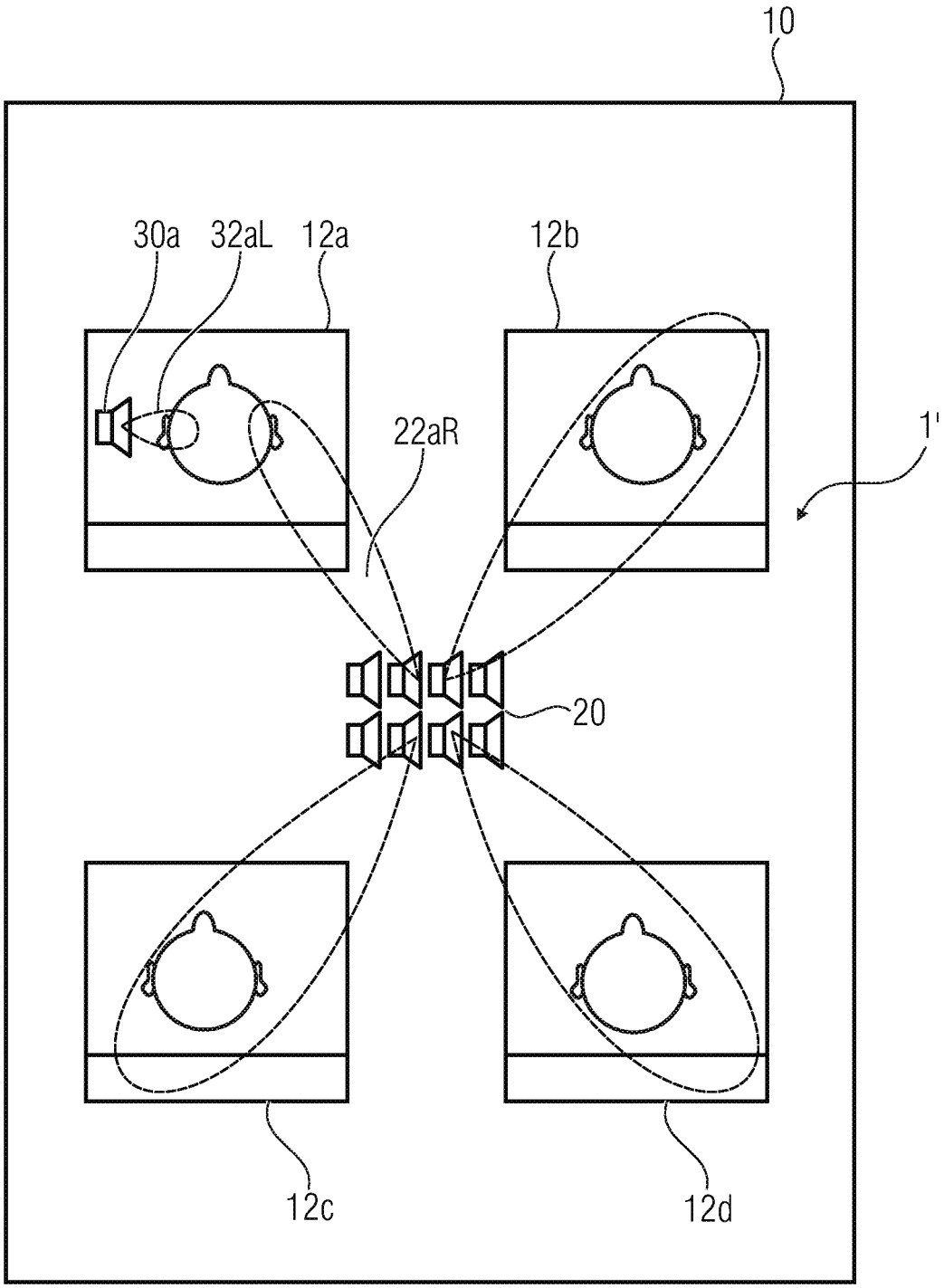
FIG. 1*c, d* are schematic diagrams of the arrangement of a loudspeaker array in combination with additional sound transducers in a vehicle according to further embodiments (partly stereo) of the first aspect.
Figure 1D:
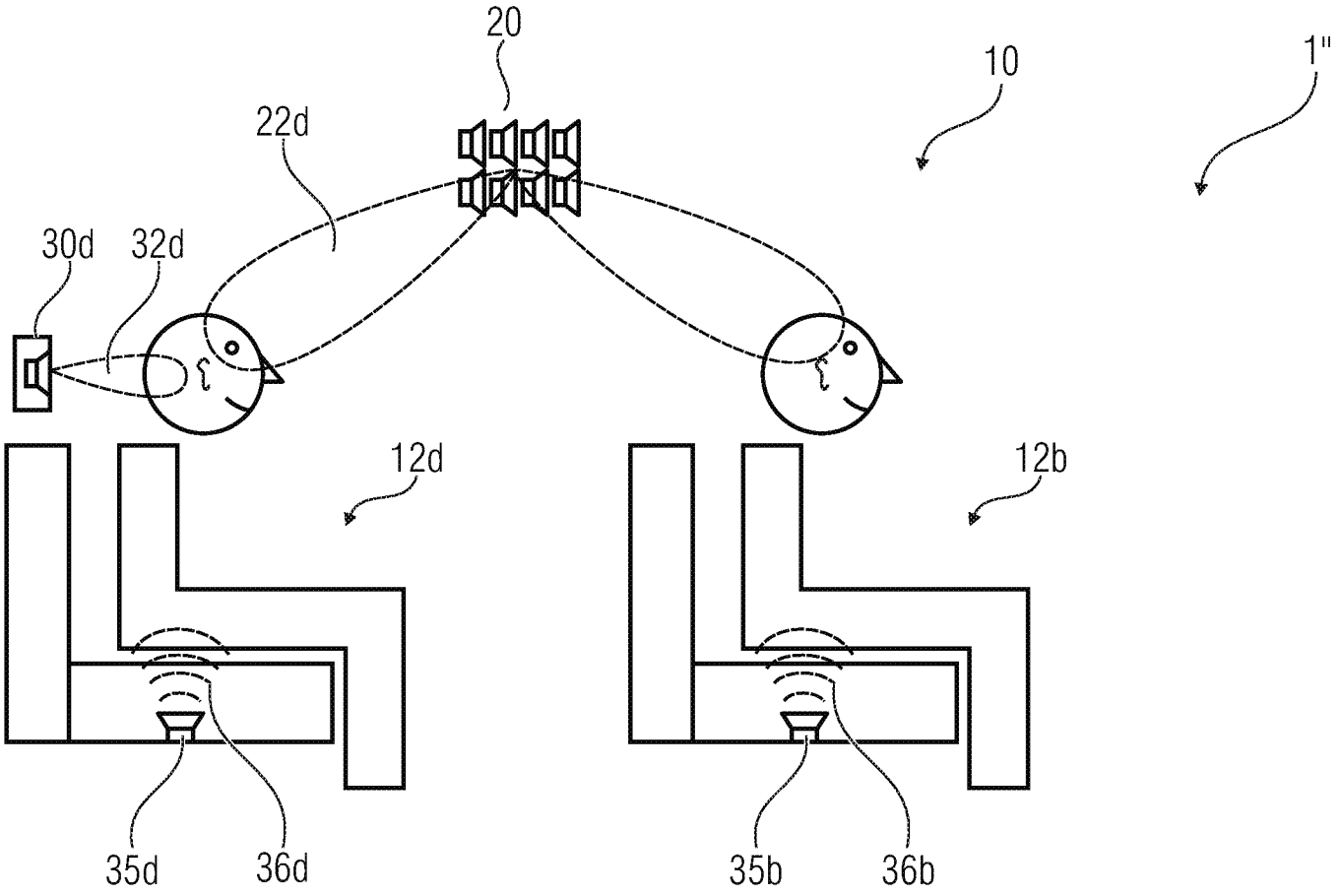

A further embodiment for the loudspeaker system is disclosed in FIGS. 1*c* and 1*d*, where the central loudspeaker array 20 is combined with at least one additional loudspeaker or additional loudspeaker array (or generally with an additional system including at least one additional loudspeaker). Possible positions for the additional loudspeaker(s) are the A, B, C column, the headrest or the roof lining.

FIG. 1*c* shows the vehicle interior 10 (top view) with the four listening positions 12*a*-12*d*, the centrally arranged loudspeaker array 20 of the loudspeaker system 1', wherein an additional loudspeaker 30*a* (here, for example, in the roof lining, alternatively B column or headrest) is allocated to the first listening position 12*a*. From the point of view of the listener, at the listening position 12*a*, this additional loudspeaker 30*a* is on a side facing away from the loudspeaker array 20 (here on the left) and is advantageously but not necessarily closer to the ear than the central loudspeaker array 20. Thereby, it is also ensured that a further optional condition, namely that the additional loudspeaker 30*a* is arranged closer to a listening position 12*a* compared to the other listening positions 12*b*-12*d* is fulfilled.

As illustrated herein, the additional loudspeaker 30*a* generates a beam 32*a*L allocated to the one (left) ear of the listener at a listening position 12*a*, while the other (right) ear is exposed to sound by the beam 22*a*R (generated by the loudspeaker array 20). Thus, in the illustrated embodiment, it is possible to generate stereo at the listening position 12*a*. The usage of the additional loudspeaker 30*a* is not limited to stereo, in that way, the additional loudspeaker 30*a* can generally serve to support sound exposure at the listening position 12*a* (mono with level increase). Here, it is advantageous that the additional loudspeaker 30*a* is positioned close to the listening position, such that the principles of sound level drop with distance are used, which has the effect that the sound level of the additional loudspeaker 30*a* is louder in the allocated listening zone 12*a* than in the other listening zones 12*b*-12*d*. This contributes, in particular, to an increased acoustic separation of the sound zones 12*a*-12*d*. Generally, the advantages of an additional loudspeaker 30*a* can be that the sound quality and the spatial impression for the allocated sound zone are improved by using psychoacoustic effects. Generally, it should be noted that by arranging sound transducers 20 and 30*a*, respectively, as close as possible to the listening position (here, 12*a*), cf., e.g., sound transducers 20 and 30*a* with regard to the listening position 12*a*, the proportion of direct sound increases, such that reflections are hidden as far as possible or are negligible.

FIG. 1*d* shows the vehicle interior 10 with a loudspeaker system 1" in a side view. Here, the listening position 12*b* and the listening position 12*d* are illustrated, where it can further be seen that the loudspeaker array 20 is arranged centrally above the listening positions 12*d* and 12*b* (i.e. in the roof lining). For the (rear) listening position 12*d*, to which the beam 22 is oriented, an additional loudspeaker 30*d* is provided (here, in the rear shelf for generating the beam 32*d*) which corresponds to the additional loudspeaker 30*a* of FIG. 1*c* as regards to characteristics and purpose.

According to further embodiments, as also illustrated in FIG. 1*d*, it is possible that a structure-borne sound exciter is provided as an additional loudspeaker per listening position, here 12*d* and 12*b*. In the illustrated embodiment, the seat for the listening position 12*b* includes the structure-borne sound exciter 35*b* while the seat for the listening position 12*d* includes the structure-borne sound exciter 35*d*. Each of these structure-borne sound exciters 35*b* and 35*d* is mechanically firmly connected to the seat (seat frame or headrest) for the listening position 12*b* and 12*d*, respectively, (e.g. via the foot space) or generally allocated to the location of the listener and configured to output the structure-borne sound 36*b* and 36*d*, respectively, such that the same reaches the respective listener. These structure-borne sound transducers 35*b* and 35*d* are particularly suited as support in the bass range where sound reproduction with small arrays (due to the limited array size) could not be sufficiently focused. By optional sound decoupling means, it can be ensured that the structure-borne sound 36*d* and 36*b*, respectively, cannot be perceived in other listening zones, e.g. 12*a* and 12*c*, which again contributes to increasing the acoustic separation between the sound zones 12*a*-12*d*.

Figure 2A:
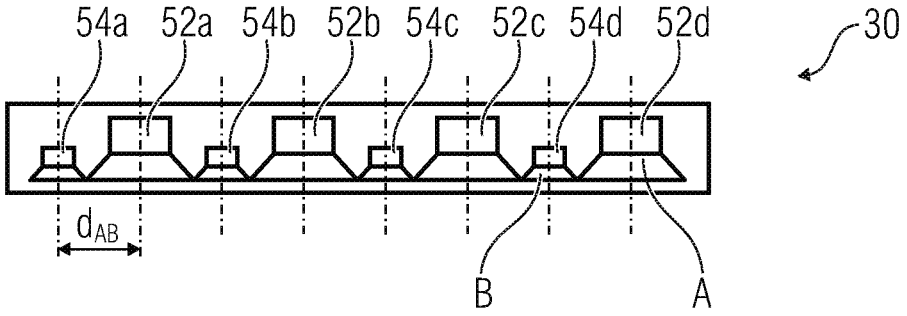
FIG. 2*a* is a schematic diagram of a loudspeaker array with sound transducers of different types for the loudspeaker system according to the embodiments of FIGS. 1*a*-1*d;*

FIG. 2*a* shows a loudspeaker array 50 with a plurality of sound transducers 52*a*-52*d* of type A and a plurality of sound transducers 54*a*-54*d* of type B. The sound transducers of type A differ in particular with regard to their size and hence typically but not necessarily, in their transferable frequency range from the electroacoustic sound transducers 54*a*-54*d* of type B (B for the treble range, e.g. >1000 Hz or 500 Hz; A for the bass range, e.g. <2000 Hz or <500 Hz). Further, the directional characteristic of the sound transducers 52*a*-52*b* of type A can also differ from the sound transducers 54*a* and 54*b* of type B. The sound transducers 52*a*-52*d* and 54*a*-54*b* are arranged in the form of a linear sound transducer array and comprise, all in all, less sound transducers than a structure with 2 parallel arrays of type A and B of the same length. These array arrangements 50 shown in FIG. 2*a* in line shape can be used as arrays for the loudspeaker systems 1, 1' or 1" of FIG. 1*a*-1*d*.

Even when the array discussed with regard to FIG. 2*a* has been illustrated in the form of A, B, A, B, A, B, A, B, the basic idea of alternate arrangement can also be transferred to sound transducer arrays having more than two different sound transducer types, such that for example also a sound transducer arrangement of A, B, C, A, B, C would be possible. A further possible alternative would be the sound transducer arrangement A, A, B, B, A, A, B, B.

Figure 2B:
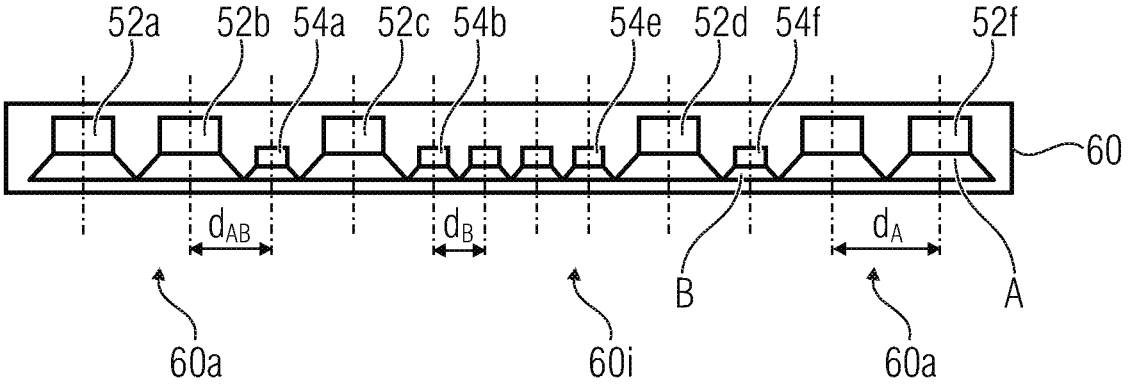
FIG. 2*b* is a schematic diagram of a linear loudspeaker array with sound transducers of different types according to the embodiment of the second aspect.

A loudspeaker array 60 where further advantages become obvious will be discussed with regard to FIG. 2*b*. Concerning the loudspeaker array 60, it should also be noted that the same could also be used for loudspeaker systems outside the motor vehicle sector, or that merely the array 60 provides advantages. FIG. 2*b* shows a loudspeaker array 60 with the sound transducers 52*a*-52*f* (type A) and the sound transducers 54*a*-54*f* (type B). Here, the sound transducers 52*a*-52*f* and 54*a*-54*f* are arranged along the line of the array 60 such that an average distance $d_B$ of the sound transducers 54*a*-54*f* is smaller than an average distance $d_A$ of the sound transducers 52*a*-52*f*, cf. $d_B<d_A$. Further, it can also be determined that the average distance of the sound transducer of type B $d_B$ is smaller than the medium average distance $d_{AB}$ of all used sound transducers (cf. FIGS. 2*a* and 2*b*). Such a formation of the average distance $d_B$ in relation to the average distance $d_A$ can be realized by the respective order of the different sound transducers 52*a*-52*f* and 54*a*-54*f*, respectively.

As illustrated in FIG. 2*b*, a possible mode of realization would be the combination of the sound transducers in the form of A, A, B, A, B, B, B, A, B, A, A. In the array 60 illustrated in FIG. 2*b*, four sound transducers of type B, cf. 54*b*-54*e* are arranged in the interior 60*i*, which are encompassed by one sound transducer of type A (cf. 52*c* and 52*d*) each per side, wherein this arrangement is again encompassed by one sound transducer of type B (cf. 54*a* and 54*f*) each. This entire sound transducer arrangement is then again encompassed by two sound transducers of type A (cf. 52*a*, 52*b*, 52*e* and 52*f*) each per side. In other words, such a distribution can also be described as logarithmic or at least approximately logarithmic.

In this sound transducer arrangement of the array 60, it can be ensured that a high density of sound transducers of type B is provided in the interior (cf. area marked by reference number 60*i*), which operate in the treble range and, by tendency, are characterized by a good adjustment of the radiation characteristic. This applies in particular compared to the exterior or the exterior areas 60*a*, respectively. By such an arrangement, the two conditions inherent to the system can be taken into account, namely that the loudspeaker array 60 should be greater than the wave length for focused radiation, which is in particular problematic for bass reproduction due to the size of the sound transducers 54*a*-54*h* and that simultaneously the distance of adjacent loudspeakers should be smaller than the wave length for error-free reproduction, which is in particular problematic for treble reproduction due to the size of the sound transducers 52*a*-52*h*.

Figure 2C:
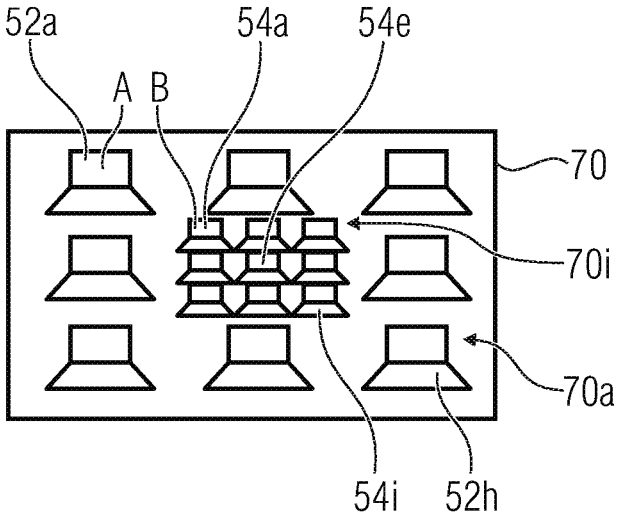
FIG. 2*c* is a schematic diagram of a loudspeaker array with planar-arranged sound transducers of different types according to a further embodiment of the second aspect.

The principle of the quasi-logarithmic arrangement described in FIG. 2*b* can also be transferred to planar sound transducer arrays as shown in FIG. 2*c*. FIG. 2*c* shows an array 70 with a central sound transducer 54*e* of type B surrounded by all in all 8 sound transducers 54*a*-54*i* of type B all around (i.e. one on each side). In that way, the electroacoustic sound transducers 54*a*-54*d* generate a 3×3 field of electroacoustic sound transducers 54*a*-54*d* of type B. With regard to the entire sound transducer arrangement 70, this 3×3 field of sound transducers 54*a*-5*ei* is in the center of the array area 70. This center is indicated by reference number 70*i*. The 3×3 field of sound transducers 54*a*-54*i* is again surrounded by the sound transducers 52*a*-52*h* of type A all around.

In this embodiment, the average distance of the sound transducers 54*a*-54*i* referred to as density due to the two-dimensionality is smaller than the average distance of the sound transducers 52*a*-52*h* in the exterior 70*a*. This means that the density in the interior 70*a* compared to the density of the exterior 70*a* (defined by the number of sound transducers 52*a*-52*h* and 54*a*-54*i* per area) is higher. Even with this area arrangement, a small sound transducer distance to the highly focused radiations in the sound transducers 54*a*-54*i* for high frequency ranges can be obtained and a designinduced greater sound transducer distance (to the focused radiation) for the lower frequency ranges (cf. sound transducers 52*a*-52*h*).

Even when the planar sound transducer arrangement has only been explained in the shape of a checker-board pattern of the sound transducer array 70, it should be noted that also other planar arrangements, e.g. concentric arrangements having a concentration of sound transducers of a specific type (B) in a specific region, e.g. in the center (70*i*) would be possible where the "sound transducer density" varies across the area. The arrangement of the sound transducers of type A/B does not necessarily have to be symmetric. In that way, also, asymmetric arrangements, i.e. slightly offset treble array (cf. 54*a*-54*i*) in the center 70*i* of the bass array (cf. 52*a*-52*h*) would be possible. Advantageously, reduction of artefacts in the radiation function due to discontinuity points can be obtained in that way. The reason for such effects is, for example, edge reflection in tweeters that are placed centrally on the front of the housing.

The loudspeaker arrays 60 and 70 can be used as arrays for the embodiment of FIG. 1*a*-*d* and have, compared to the loudspeaker array of FIG. 2*a*, advantages with regard to directivity, in particular when beamforming for adjusting the directional characteristic both in the low frequency and in the high frequency range and can above that contribute to the prevention of spatial aliasing effects.

The concentration of sound transducers of type B in the center 60*i* and 70*i* and of sound transducers of the type A in the exterior 60*a* and 70*a* obtained by the sound transducer arrays 60 and 70 can also be obtained by a sound transducer arrangement having two levels as described with reference to FIG. 2*d*.

Figure 2D:
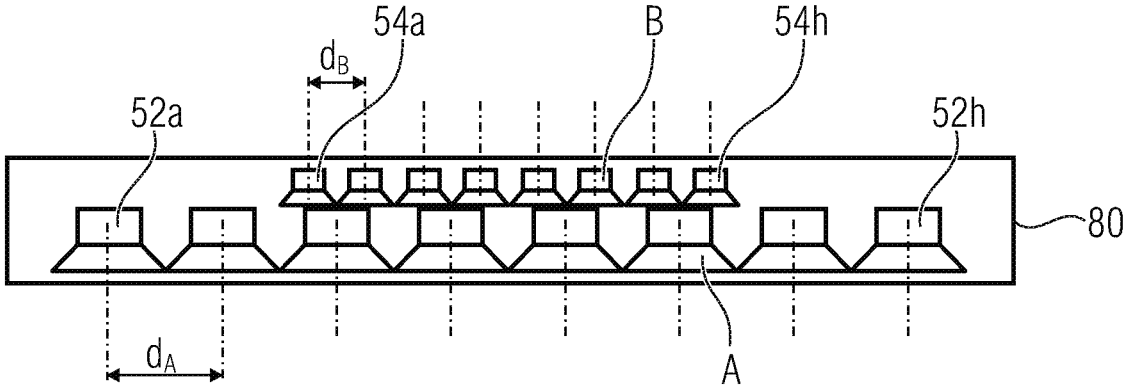
FIG. 2*d* is a diagram of a loudspeaker array with sound transducers of different types according to an additional embodiment of the second aspect.

FIG. 2*d* shows a loudspeaker array 80 having a plurality of sound transducers 52*a*-52*h* (type A) arranged linearly (directly) beside one another in a first plane. Further, the sound transducer array 80 includes a plurality of sound transducers 54*a*-54*h* (type B) that are also linearly arranged beside one another (abutting). These two sound transducer types 52*a*-52*h* and 54*a*-54*h* are arranged in two different planes, i.e. behind one another or also offset and above one another, respectively. Both arrangements of the line arrays have in common that the line on which the sound transducers 52*a*-52*h* and 54*a*-54*h* are arranged is equal, meaning parallel. Thus, despite the direct juxtaposition of the sound transducers of the same type 52*a*-52*h* and 54*a*-54*h*, respectively, it is possible that the average distance $d_B$ of the sound transducers of type B (54*a*-54*h*) is smaller than the average distance $d_A$ of the sound transducers of type A (52*a*-52*h*).

It should be noted that it is insignificant for this embodiment whether the sound transducers of type A are arranged in the first or second plane and vice versa also whether the sound transducers of type B are arranged in the first or second plane.

Optionally, however, it is important that the sound transducers of type B arranged with a low average distance $d_B$ are positioned in the center of the sound transducer arrangement of type A, such that this embodiment of the loudspeaker array can also obtain a concentration of sound transducers for the high-frequency range in the center.

In further embodiments, it would also be possible that further sound transducers, i.e. sound transducers of type C, are arranged in a third plane.

With reference to the loudspeaker arrangements of FIG. 2*a*-2*d* it should be noted that complex directional characteristics, can be allocated to the individual transducers 52*a*-52*h* and 54*a*-54*h*, respectively, e.g. by sound guides or by the sound transducer itself.

A further embodiment relates to a combination of several line arrays, such as arrays 50 and 60, such that a planar loudspeaker array is formed. The line array 50 or 60 can have a different number of sound transducers, such that, for example also different lengths of the line arrays result. Further, it would also be possible that the sound transducer distances per line array vary, e.g. based on the fact that different sound transducer types can be used.

According to further embodiments, each line array can by itself include different sound transducer types, wherein the combination of line arrays having one type per line array is advantageous. An embodiment is characterized in that two line arrays with the sound transducer type A enclose three line arrays having the sound transducer type B. In that way, a planar loudspeaker array is formed, where a specific type of sound transducers is concentrated in the center.

Figure 3:
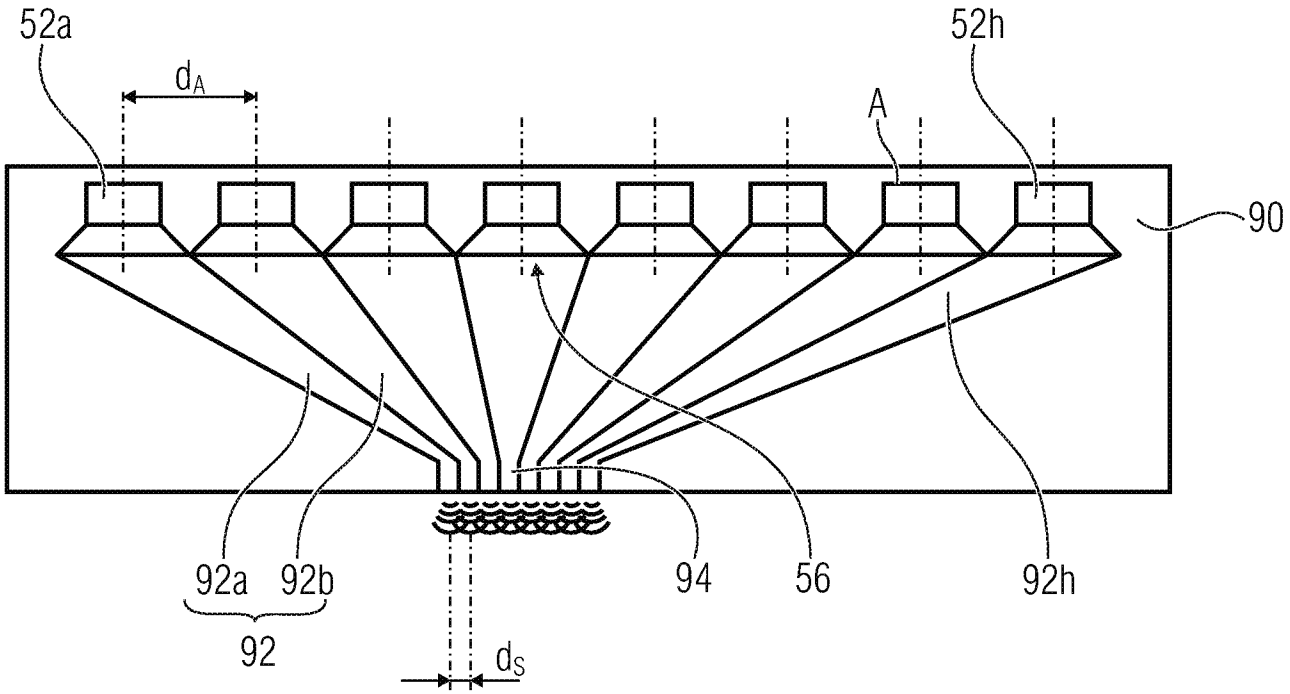
FIG. 3 is a schematic diagram of a loudspeaker array with a plurality of sound guides according to an embodiment of the third aspect.

With reference to FIG. 3, an extension for the above loudspeaker arrays will be described below, wherein the extension is not limited to such arrays or the motor vehicle sector.

FIG. 3 shows a loudspeaker array 90, here implemented as combination of eight sound transducers 52*a*-52*h* of the same type. Each of these sound transducers 52*a*-52*h* or, to be more accurate, the membrane 56 of the sound transducers 52*a*-52*h*, is coupled to a sound guide 92*a*-92*h* on its radiation side. These sound guides 92*a*-92*h* are funnel-shaped and optionally bent elements, such that the sound outlet openings (cf. reference number 94) of the sound guide 92*a*-92*h* are smaller (in all or at least one dimension) than the sound inlet openings (cf. reference no. 56) on the side of the electroacoustic sound transducers 52*a*-52*h*. The funnel of the sound guide 92*a*-92*h* is configured such that the sound input 56 is offset compared to the sound outlet openings 94, wherein, depending on the combination with a sound transducer 52*a*-52*h*, a different offset ratio is used, such that the total area of the sound outlet openings can be reduced as a whole.

Hereby, the sound outlet openings 94 of the sound guides 92*a*-92*h* can be arranged tightly beside one another with an average distance $d_S$. As a consequence, despite the loudspeaker array 90 with large-scale extension, a very small average distance $d_S$ is obtained between the sound outlet openings 94 (in particular compared to the average distance $d_A$), which results in an improved adjustable directional characteristic (due to the reduction of the sound radiation area by the compact distance $d_S$ of the sound outlet openings 94 and due to the reduced virtual sound transducer distance $d_S$, respectively) and better positioning options of the arrays (e.g. within the vehicle).

The combination of the sound guide 92*a*-92*h* with one of the loudspeaker arrays 50, 60, 70 or 80 is possible, such that the sound guide can also be used for the embodiments of the loudspeaker system 1, 1' or 1" of FIG. 1*a*-1*d*. Thereby, it is also possible (as already indicated above) to configure the sound guide 92 such that the actual sound transducer array 90 (or also 50, 60, 70, 80) is installed at a specific position within the car (e.g., in the trunk), e.g. due to lack of space, and the sound guide guides the sound to the respective sound outlet point, e.g. in the roof, which allows space-saving installation.

With regard to FIG. 1, it should be noted that the arrangement of the loudspeakers and loudspeaker arrays of the loudspeaker system, respectively, can also be carried out with a predetermined orientation, e.g. onto the listening positions 12*a*-12*d*, such that a directed radiation per sound transducer is possible, which contributes to a reduction of the influence on room acoustics in the sound zones by the position of the loudspeakers.

According to further embodiments, also, a signal control apparatus can be provided which controls the array 20 and the extended arrays 50, 60, 70, 80 90, respectively, according to the above-described principles (cf. mono reproduction of the listening zone 12*a*-12*d* or stereo reproduction of the listening zone 12*a*-12*d*) and hence allows the formation of the respective number of highly focused sound radiation beams 22*a*-22*d*, 22*a*L, 22*a*R.

With reference to FIG. 1, it should further be noted that user-specific signals could also mean the fading-in of other audio information, such as in infotainment signals or telecommunication audio, into a specific listening zone, e.g. the driver listening zone 12*a*.

According to further embodiments, the loudspeaker system can include a frequency-separating means or a processor that is configured to provide the central and higher frequencies of the input signal, when the same includes only listening content (i.e. content for a person at the respective listening/seating position), to the array, e.g. in the way that beamforming can be performed, and to output the lower frequencies at the structure-borne sound transducer of the respective seating position. In the case that the audio content to be reproduced includes several parallel contents, e.g. intended for different listening/seating positions), the frequency-separating means and the audio processor, respectively, are configured to provide the central entire frequencies of all audio content to be reproduced to the array, in the way that the audio content can be reproduced separately for the different listening zones at the different listening positions by means of beamforming, while the lower frequencies are split off and passed on to the different structure-borne sound transducers of the different seats and listening positions, respectively. All in all, this offers the advantage that central and higher frequencies can be reproduced in a directed manner for the different listening positions by means of the array, while the lower frequencies are represented only locally via the structure-borne sound transducer. The reason for this procedure is that in particular the low frequencies cannot be directed so well via arrays, such that separation of the same by means of beamforming frequently causes problems. By using the structure-borne sound transducers explicitly allocated to the individual seating and listening positions, respectively, no overlap of the sound signals of these sound transducers will occur.

Further embodiments provide a loudspeaker array having a plurality of first electroacoustic sound transducers arranged on a first line, and a plurality of second electroacoustic sound transducers arranged on the first line or a line parallel to the first line. Here, an average distance ($d_B$) between the first electroacoustic sound transducers is smaller than an average distance ($d_B$) between the second electroacoustic sound transducers.

Further embodiments provide a loudspeaker array having a plurality of first electroacoustic sound transducers arranged in a first planar area and a plurality of second electroacoustic sound transducers arranged in the first planar area. Here, an average density of the first electroacoustic sound transducers is smaller than an average density of the second electroacoustic sound transducers.

Further embodiments provide a loudspeaker array having a plurality of electroacoustic sound transducers coupled to first sound guides for sound output in a first area, wherein each sound guide includes a sound outlet opening. Here, the plurality of sound outlet openings is arranged such that an average distance ($d_S$) between the sound outlet openings is smaller than a possible average distance ($d_A$) between the juxtaposed electroacoustic sound transducers.

With reference to the loudspeaker array 20 of FIG. 1*a*-1*d*, it should be noted that the geometrical orientations of the sound transducers 20*a*-20*h* in the loudspeaker array 20 illustrated in the schematic drawings is hypothetical and does not necessarily reflect reality. Thus, the orientations of the individual sound transducers 20*a*-20*h* can deviate accordingly or can even vary from position to position (strongly tilted to the first side, tilted to the first side, towards the bottom, tilted to the second side, strongly tilted towards the second side).

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Loudspeaker system for a vehicle, comprising:

a loudspeaker array comprising a plurality of electroacoustic sound transducers that can be controlled individually, such that a user-specific audio signal can be reproduced for different users at different listening positions in a vehicle interior via the plurality of electroacoustic sound transducers, wherein the loudspeaker array is arranged in a roof lining of the vehicle, centrally between at least all listening positions in the vehicle interior, such that a distance between the loudspeaker array and all of the listening positions is the same, with a deviation of +/−30%, wherein the loudspeaker system comprises, per listening position, at least one additional loudspeaker system comprising at least one additional loudspeaker or an additional loudspeaker array, wherein the additional loudspeaker system comprises a structure-borne sound loudspeaker that is arranged in a foot space allocated to the listening position, in a seat allocated to the listening position and/or a headrest allocated to the listening position and/or that is mechanically coupled to the seat allocated to the listening position;

wherein the loudspeaker system is configured to perform, with the help of the plurality of the electroacoustic sound transducers of the loudspeaker array, acoustic beamforming for forming the beams;

wherein middle and higher frequencies are reproduced in a directed manner for the different listening positions by means of the array, while the low frequencies are only represented locally via the structure-bound sound transducer.

2. Loudspeaker system according to claim 1, wherein the additional loudspeaker system is closer to the user than the loudspeaker array.

3. Loudspeaker system according to claim 1, wherein the additional loudspeaker system is arranged in a seat allocated to the listening position, a position of the A column, B column, C column allocated to the listening position and/or the roof lining and/or a headrest allocated to the listening position.

4. Loudspeaker system according to claim 1, wherein the additional loudspeaker system is configured to output sound such that, with regard to the further listening positions, a large part of the sound reaches the respective listening position.

5. Loudspeaker system according to claim 1, wherein the additional loudspeaker system is arranged closer to one ear of the user than to the other ear of the user.

6. Loudspeaker array according to claim 5, wherein the loudspeaker array comprises a further plurality of third electroacoustic sound transducers.

7. Loudspeaker system according to claim 1, wherein the loudspeaker system is configured, with the help of the additional loudspeaker system, to reproduce stereo per listening position or mono with local level increase.

8. Loudspeaker system according to claim 1, wherein the loudspeaker system is configured to generate, with the help of the plurality of the electroacoustic sound transducers, at least two beams or one stereo beam per listening position; and/or wherein the loudspeaker system is configured to virtually position sound sources in space by using transfer functions emulating psychoacoustic effects.

9. Loudspeaker system according to claim 1, wherein beamforming is based on direct and/or indirect sound reproduction with regard to the user.

10. Loudspeaker system according to claim 1, wherein a sound pressure level and/or radiation direction per beam allocated to a listening position are selected such that the sound pressure level is below a listening threshold at other listening positions after absorption and/or reflection.

11. Loudspeaker system according to claim 1, wherein the loudspeaker system is configured to perform beamforming by considering a seat adjustment or a head position of the user at the listening position and/or to track the beams in dependence on the seat adjustment and/or the head position of the user.

12. Loudspeaker system according to claim 1, wherein the loudspeaker system comprises a control that is configured to individually control the electroacoustic sound transducers.

13. Loudspeaker system according to claim 1, wherein the loudspeaker system comprises a loudspeaker array, comprising:

a plurality of first electroacoustic sound transducers arranged on a first line; and a plurality of second electroacoustic sound transducers arranged on a first line or a line parallel to the first line, wherein an average distance between the first electroacoustic sound transducers is smaller than an average distance between the second electroacoustic sound transducers;

or a loudspeaker array, comprising:

a plurality of first electroacoustic sound transducers arranged in a first planar area; and a plurality of second electroacoustic sound transducers arranged in the first planar area, wherein an average density of the first electroacoustic sound transducers is smaller than an average density of the second electroacoustic sound transducers.

14. Loudspeaker system according to claim 13, wherein the plurality of first electroacoustic sound transducers is surrounded all around by the plurality of second electroacoustic sound transducers.

15. Loudspeaker array according to claim 13, wherein at least two of the first electroacoustic sound transducers are encompassed by two of the second electroacoustic sound transducers.

16. Loudspeaker array according to claim 13, wherein the first electroacoustic sound transducers are configured to reproduce a first frequency range defined by a first center frequency and the second electroacoustic sound transducers are configured to reproduce a second frequency range defined by a second center frequency, wherein the first center frequency is higher than the second center frequency.

17. Loudspeaker system for a vehicle, comprising:

a loudspeaker array comprising a plurality of electroacoustic sound transducers that can be controlled individually, such that a user-specific audio signal can be reproduced for different users at different listening positions in a vehicle interior via the plurality of electroacoustic sound transducers, wherein the loudspeaker array or a sound outlet of the loudspeaker array is arranged between at least two of the listening positions in the vehicle interior, wherein the loudspeaker system comprises, per listening position, at least one additional loudspeaker system comprising at least one additional loudspeaker or an additional loudspeaker array, wherein the additional loudspeaker system comprises a structure-borne sound loudspeaker that is arranged in a foot space allocated to the listening position, in a seat allocated to the listening position and/or a headrest allocated to the listening position and/or that is mechanically coupled to the seat allocated to the listening position, wherein the loudspeaker system comprises a loudspeaker array, comprising:

a plurality of electroacoustic sound transducers coupled to first sound guides for sound output in a first area, wherein each sound guide comprises a sound outlet opening, wherein the plurality of sound outlet openings are arranged such that an average distance between the sound outlet openings is smaller than a possible average distance between the juxtaposed electroacoustic sound transducers.

* * * * *